United States Patent [19]

Lue

[11] Patent Number: 4,996,934

[45] Date of Patent: Mar. 5, 1991

[54] CONNECTING DEVICE FOR CONNECTING A CLOTH PULLING ARRANGEMENT TO A SEWING MACHINE

[76] Inventor: Shueh-Chung Lue, No. 19, Ku-Luen Street, Taipei, Taiwan

[21] Appl. No.: 373,897

[22] Filed: Jun. 29, 1989

[51] Int. Cl.[5] ..... D05B 27/10

[52] U.S. Cl. ..... 112/318; 112/259

[58] Field of Search ..... 112/258, 259, 303, 311, 112/314, 318, 319, 320, 322

[56] References Cited

U.S. PATENT DOCUMENTS

| | | | |
|---|---|---|---|
| 3,262,410 | 7/1966 | Chernes | 112/320 X |
| 4,187,795 | 2/1980 | Norton | 112/320 X |
| 4,572,094 | 2/1986 | Taddicken | 112/322 |
| 4,867,083 | 9/1989 | Fietta et al. | 112/259 X |

*Primary Examiner*—Werner H. Schroeder
*Assistant Examiner*—Paul C. Lewis
*Attorney, Agent, or Firm*—Kirschstein, Ottinger, Israel & Schiffmiller

[57] ABSTRACT

A connecting device includes first and second connecting members, first and second fixing members and bolts. The first connecting member is fixed to a back of a sewing machine by means of the first and second fixing members and the bolts. The second connecting member is pivotally connected at the right side of the first connecting member. The connecting device requires only the use of existing holes on the sewing machine to install the connecting device of the present invention on the back of the sewing machine easily. No drilling of holes in the sewing machine is required.

7 Claims, 7 Drawing Sheets

CONNECTING DEVICE FOR CONNECTING A CLOTH PULLING ARRANGEMENT TO A SEWING MACHINE

BACKGROUND OF THE INVENTION

1. Field of the Invention

The present invention relates to a connecting device for connecting a cloth pulling arrangement to a sewing machine.

2. Description of the Related Art

A cloth pulling arrangement known in the prior art is designed specifically for a general purpose sewing machine already used in a ready-made clothes factory. After installation of the cloth pulling arrangement on a back of a sewing machine, a cloth pulling roller is driven by a main shaft of the sewing machine, and a belt, a governor, and a driving shaft of the cloth pulling arrangement are driven, in turn, to cope with the up-and-down movement of a needle of the sewing machine in order to pull the cloth in the sewing machine taut to resist formation of wrinkles in cloth during operation of the sewing machine and to maintain the sewn portion flat, neat and beautiful.

When the cloth pulling arrangement is added to the sewing machine, it must conform to the shape and structure of the sewing machine. It is known to utilize two connecting frames to install the pulling arrangement on a back of a post of the sewing machine.

One connecting frame is used specifically to fix the governor of the cloth pulling arrangement on the back of the post of the sewing machine. In addition, an end connecting frame is used to replace the original end plate and to fix the components of the cloth pulling arrangement, such as a pulling roller, solenoid actuator, etc. on the back of the end of a hanging arm of the sewing machine.

In order to satisfy the general custom of the operator during operation, in the majority of the time of operation, the cloth is sewn in a forward direction, and the operating direction of the cloth pulling arrangement is also designed to keep pace with the forward sewing; however, back sewing in the reverse direction is also required sometimes. During this back sewing period, the cloth pulling roller of the cloth pulling arrangement must be disengaged from the cloth. Under such circumstances, the solenoid actuator of the cloth pulling arrangement must act to lift up the pulling roller. In order to make the action of the solenoid actuator and the back sewing of the sewing machine completely synchronous, a limit switch is added below the back sewing lever of the sewing machine. When the operator wants to begin back sewing, the back sewing lever only is depressed, and then the sewing machine would begin the back sewing operation. The back sewing lever triggers the limit switch which causes the solenoid actuator to lift up the cloth pulling roller.

There are many brands of sewing machines, the trade marks of those most frequently used being Brother, Juki, Toyota, Singer ... too many to be enumerated, and each manufacturer produces various kinds of sewing machines. Besides, even sewing machines of the same type are divided into (1) automatic thread cutting (i.e. to cut off the thread automatically after completion of sewing), and (2) without automatic thread cutting. Thus, there are more than one hundred sewing machine types. More importantly, new machine types are constantly being introduced in the market, and the quantity of sewing machines of different types is increasing continuously.

In order that the cloth pulling arrangement might be installed on different shapes of sewing machines, the manufacturer of the known cloth pulling arrangement produces more than one hundred shapes of two-piece "connecting frames". In the meantime, owing to new types of sewing machines being constantly introduced into the market, the manufacturer of the known cloth pulling arrangement must increase the number of connecting frames to fit such new machine types in order to meet the requirements of ready-made clothes manufacturers. Under such circumstances, both the manufacturers of ready-made clothes and cloth pulling arrangements have been annoyed by the following problems:

1. The enormous warehousing of connecting frames annoyed the manufacturers of cloth pulling arrangements in management, manufacture and in installing the connecting frames on the scene of a sewing machine, 2. The complicated classification and specification of the connecting frames caused misunderstanding during communication between the manufacturers of ready-made clothes and cloth pulling arrangements which resulted in annoyance, 3. The process of installation of the connecting frames was troublesome; it had to be performed by an expert; ordinary ready-made clothes factories were unable to install it by themselves. It was really inconvenient to request the manufacturer of cloth pulling arrangement to dispatch a technician to install the connecting frames, and 4. Many holes had to be drilled into the sewing machine in order to fix the connecting frames. It would not only ruin the external look of the sewing machine, but also selecting appropriate positions on the case of the sewing machine of a special shape was also difficult.

SUMMARY OF THE INVENTION

In view of these problems, it is an object of the present invention to provide a connecting device for connecting a cloth pulling arrangement to a sewing device without drilling any holes on the sewing machine.

A connecting device comprises first and second connecting members, first and second fixing members and bolt means. The first connecting member is fixed to a back of a sewing machine by means of the first and second fixing members and the bolt means. The second connecting member is pivotally connected at the right side of the first connecting member. The existing holes of the sewing machine are used to install the connecting device of the present invention on the back of the sewing machine easily, and no drilling of holes is performed on the sewing machine.

The present invention utilizes an existing connecting hole on the back of the sewing machine normally used for installing a hinge to be removed for installing a locking member; and utilizes another existing connecting hole normally used for installing a lighting lamp on the back of the sewing machine to be removed for installing the first connecting member of the present invention. Then the first connecting member of the present invention is locked by the locking member on the back of the sewing machine.

A governor of the cloth pulling arrangement is installed on the first connecting member of the present invention, and a cloth pulling roller and a solenoid actuator of the cloth pulling arrangement are installed on the second connecting member of the present invention. A control circuit is used to control the solenoid actuator. A power switch is installed in a connecting box of the first connecting member.

Furthermore, the present invention also comprises a switch trigger and a control lever. The switch trigger is installed on the first connecting member, for triggering a back sewing control switch installed adjacent the switch trigger. One end of the control lever is connected to the switch trigger; the other end is positioned below a back sewing control lever of the sewing machine. Downward pressure on the back sewing control lever simultaneously triggers the back sewing control switch to excite the solenoid actuator to lift up the cloth pulling roller in order to perform back sewing.

DETAILED DESCRIPTION OF THE PREFERRED EMBODIMENT

Figure 1:
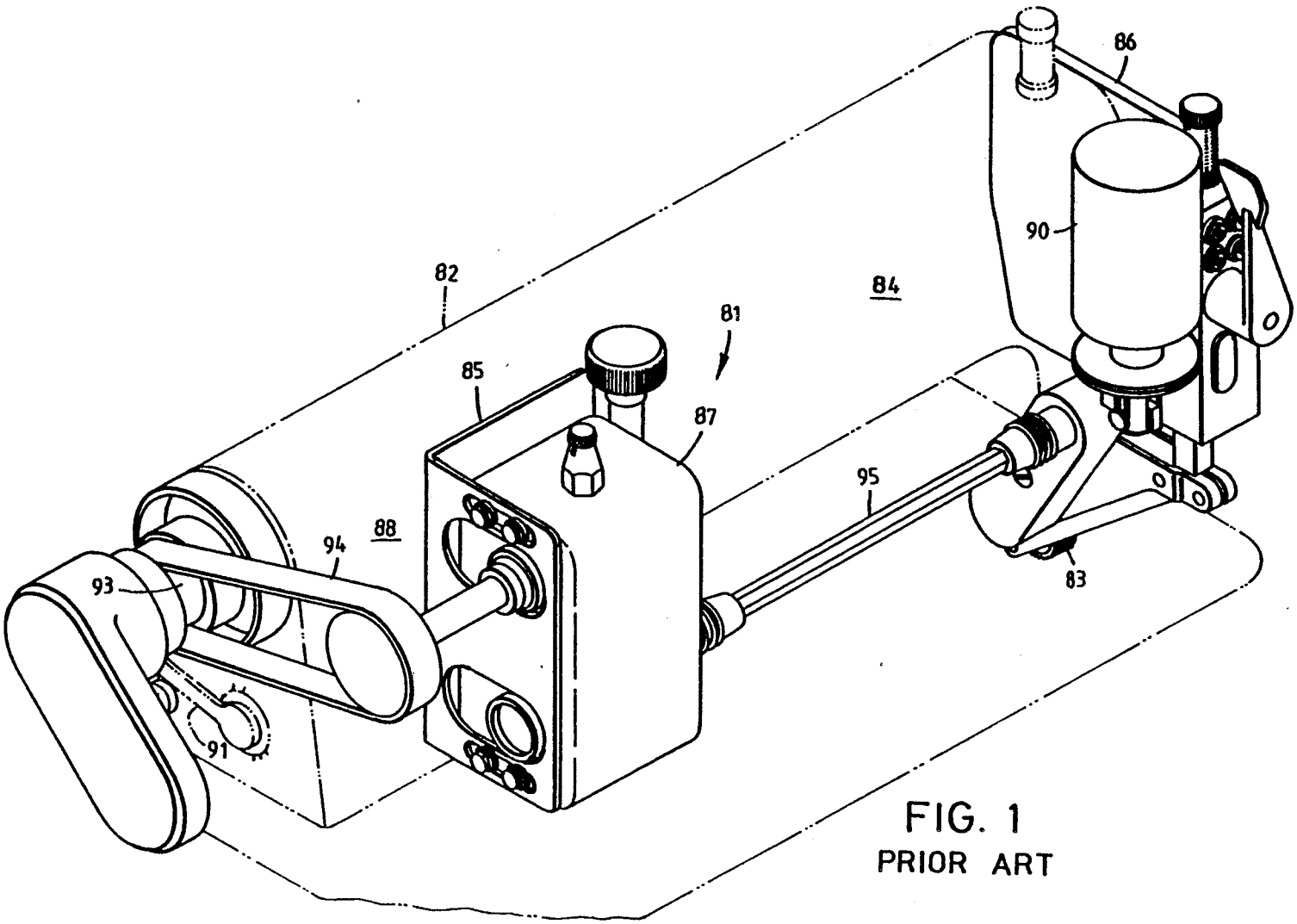
FIG. 1 PRIOR ART
FIG. 1 is an isometric view, showing a typical connecting device of the prior art.
Figure 2:
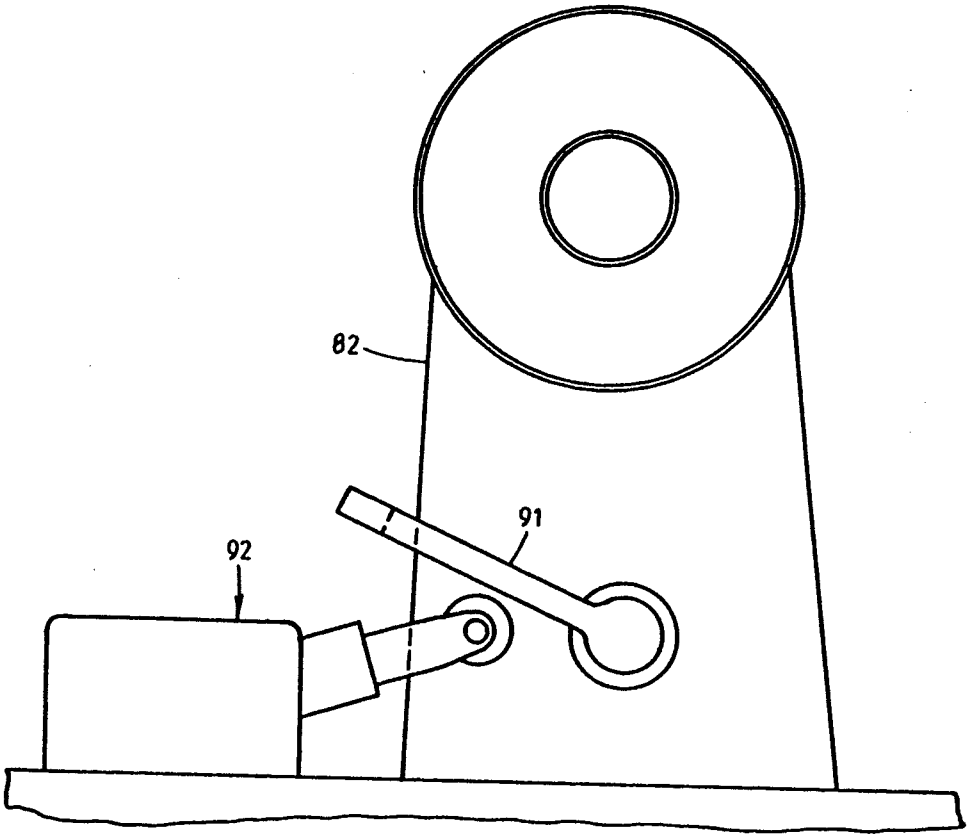
FIG. 2 PRIOR ART
FIG. 2 is a right side view of FIG. 1, showing how a back sewing control switch is operated by a sewing control lever of a known sewing machine.

As shown in FIG. 1, a cloth pulling arrangement 81 known in the prior art is designed specifically for a general purpose sewing machine already used in a ready-made clothes factory. After installing the cloth pulling arrangement 81 on a back of a sewing machine 82, a cloth pulling roller 83 is driven by a main shaft 93 of the sewing machine 82. A belt 94, a governor 87, and a driving shaft 95 of the cloth pulling arrangement are driven, in turn, to cope with the up-and-down movement of a needle of the sewing machine 82 in order to pull the cloth in the sewing machine taut to resist formation of wrinkles in the cloth during operation of the sewing machine and to maintain the sewn portion flat, neat and beautiful.

The cloth pulling arrangement 81 must conform to the shape and structure of the sewing machine. Two connecting frames 85, 86 are used to install the pulling arrangement 81 on the sewing machine 82.

The connecting frame 85 is used specifically to fix the governor 87 of the cloth pulling arrangement 81 to the back of a post 88 of the sewing machine 82. In addition, the end connecting frame 86 is used to replace the original end plate and to fix the components of the cloth pulling arrangement 81, such as the pulling roller 83, a solenoid actuator 90, etc., on the back 84 of the end of a hanging arm of the sewing machine 82.

In order to cope with general custom of the operator during operation, in the majority of the time of operation, the cloth is sewn in a forward direction, and the operating direction of the cloth pulling arrangement is also designed to keep pace with the forward sewing; however, back sewing in the reverse direction is also required sometimes. During this back sewing period, the cloth pulling roller 83 of the cloth pulling arrangement must be disengaged from the cloth. Under such circumstances, the solenoid actuator 90 of the cloth pulling arrangement must act to lift up the pulling roller 83. In order to make the action of the solenoid actuator 90 and the back sewing of the sewing machine completely synchronous, a limit switch 92 is added below a back sewing lever 91 of the sewing machine. When the operator wants to begin back sewing, the back sewing lever 91 only is depressed, and then the sewing machine would begin the back sewing operation. The back sewing lever 91 triggers the limit switch 92 which causes the solenoid actuator 90 to lift up the cloth pulling roller 83.

There are many brands of sewing machines, the trade marks of those most frequently used being Brother, Juki, Toyota, Singer...too many to be enumerated, and each manufacturer produces many kinds of sewing machines. Besides, even sewing machines of the same type are divided into (1) automatic thread cutting (i.e. to cut off the thread automatically after completion of sewing), and (2) without automatic thread cutting. Thus, there are more than one hundred sewing machine types. More importantly, new machine types are constantly being introduced in the market, and the quantity of sewing machines of different types is increasing continuously.

Figure 3:
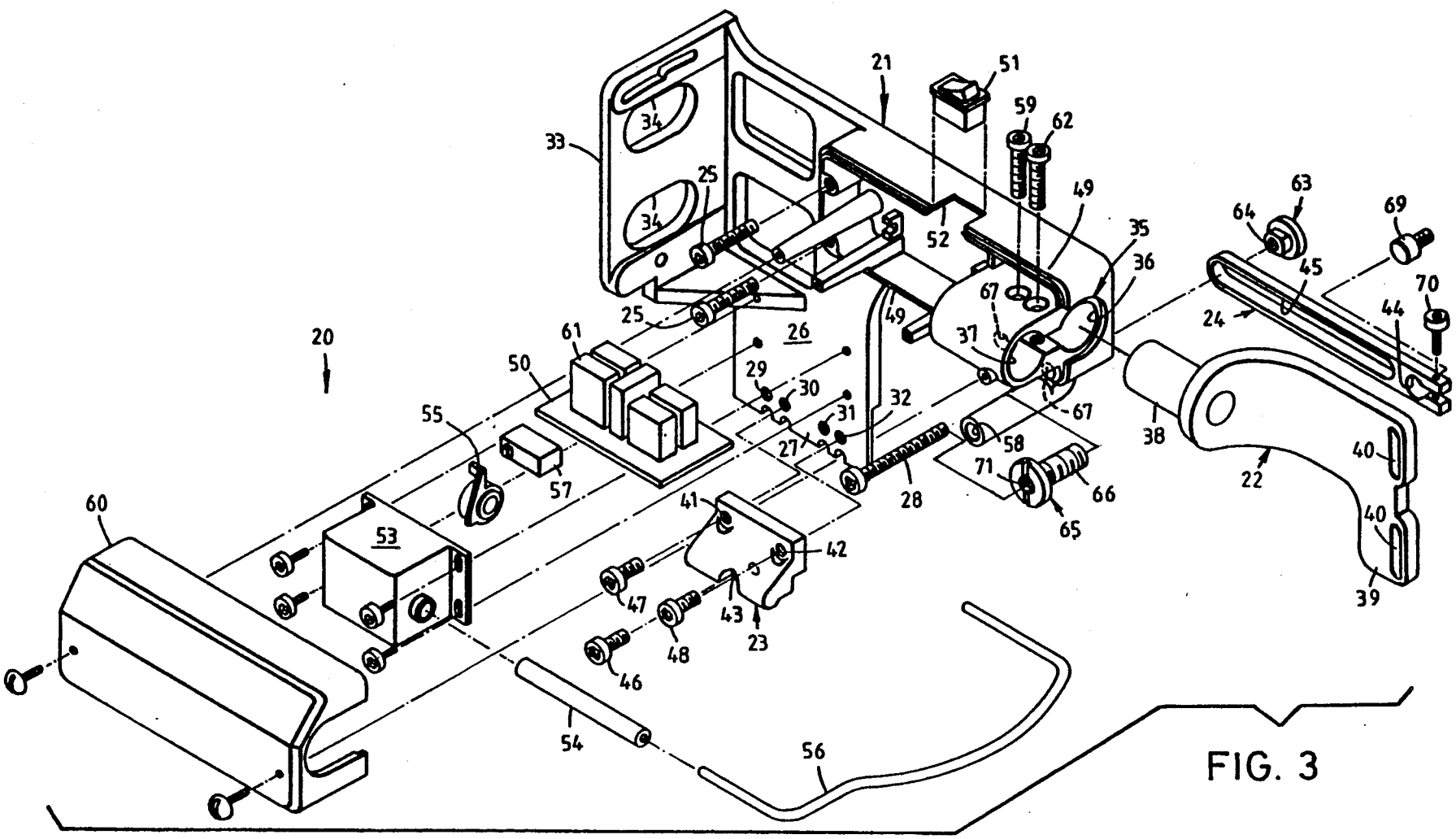
FIG. 3 is an exploded isometric view, showing all components of the present invention.

Referring to FIG. 3, the connecting device 20 of the present invention comprises a first connecting member 21; a second connecting member 22; a first fixing member 23; a second fixing member 24; and at least one bolt 25.

Figure 4:
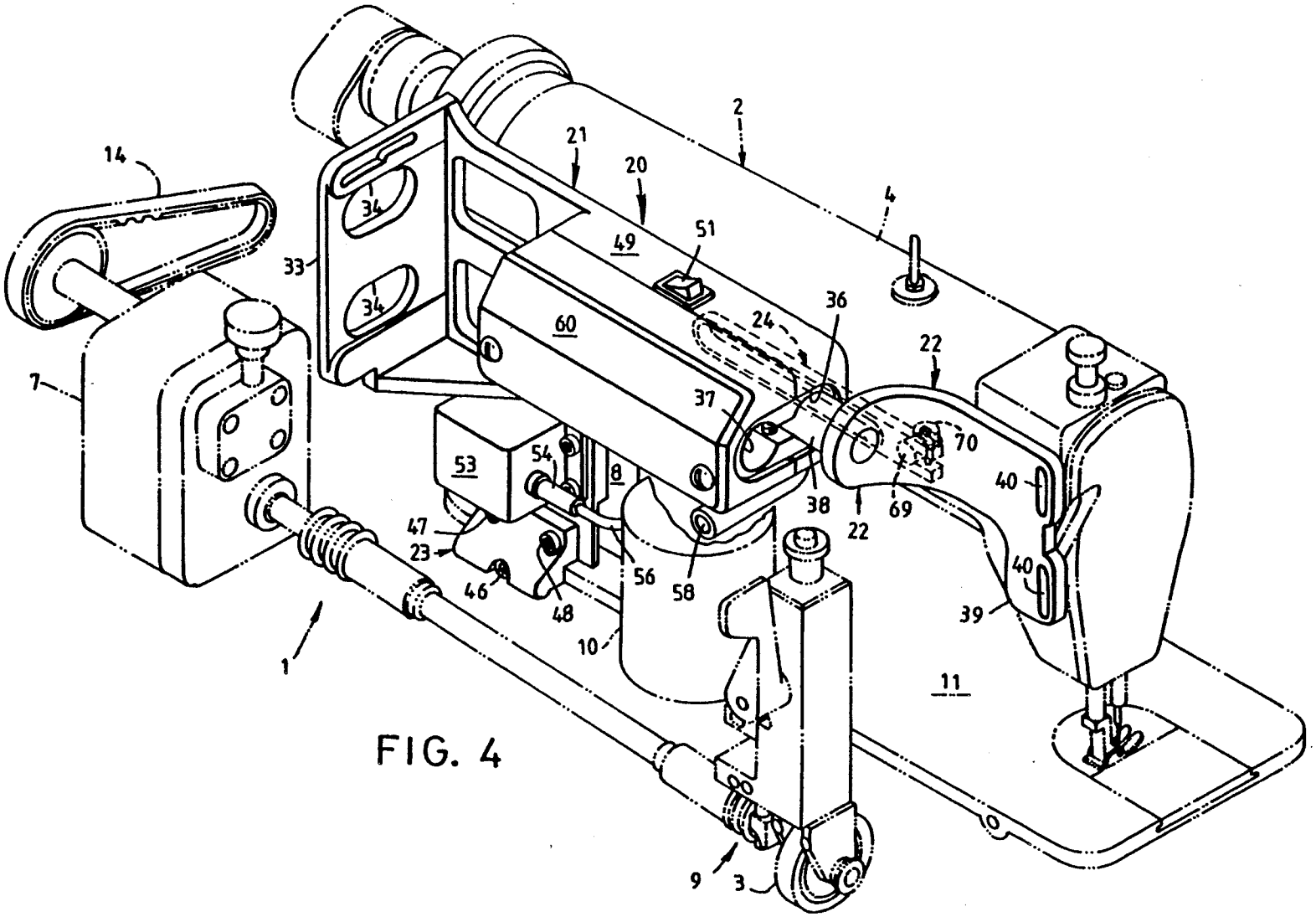
FIG. 4 is an exploded isometric view, showing the connecting device which has been attached to the back side of a sewing machine and a cloth pulling arrangement ready for connection to the connecting device, in accordance with the present invention.

The first connecting member 21 comprises a first connecting portion 26 and a fixing portion 27 on its bottom (i.e., the first side) The fixing portion 27 is constituted by four fixing holes 29, 30, 31, 32. A second connecting portion 33 extends from the left side (i.e., the second side) of the first connecting portion 26 and perpendicular to the first connecting portion 26 There are two fixing grooves 34 (or fixing holes) on the second connecting portion 33 to be used to fix the governor 7 of the cloth pulling arrangement 1 (as shown in FIG. 4). A third connecting portion 35 has a first pivot hole 36 and a second pivot hole 37 to facilitate pivoting with the second connecting member 22.

Figures 5, 6:
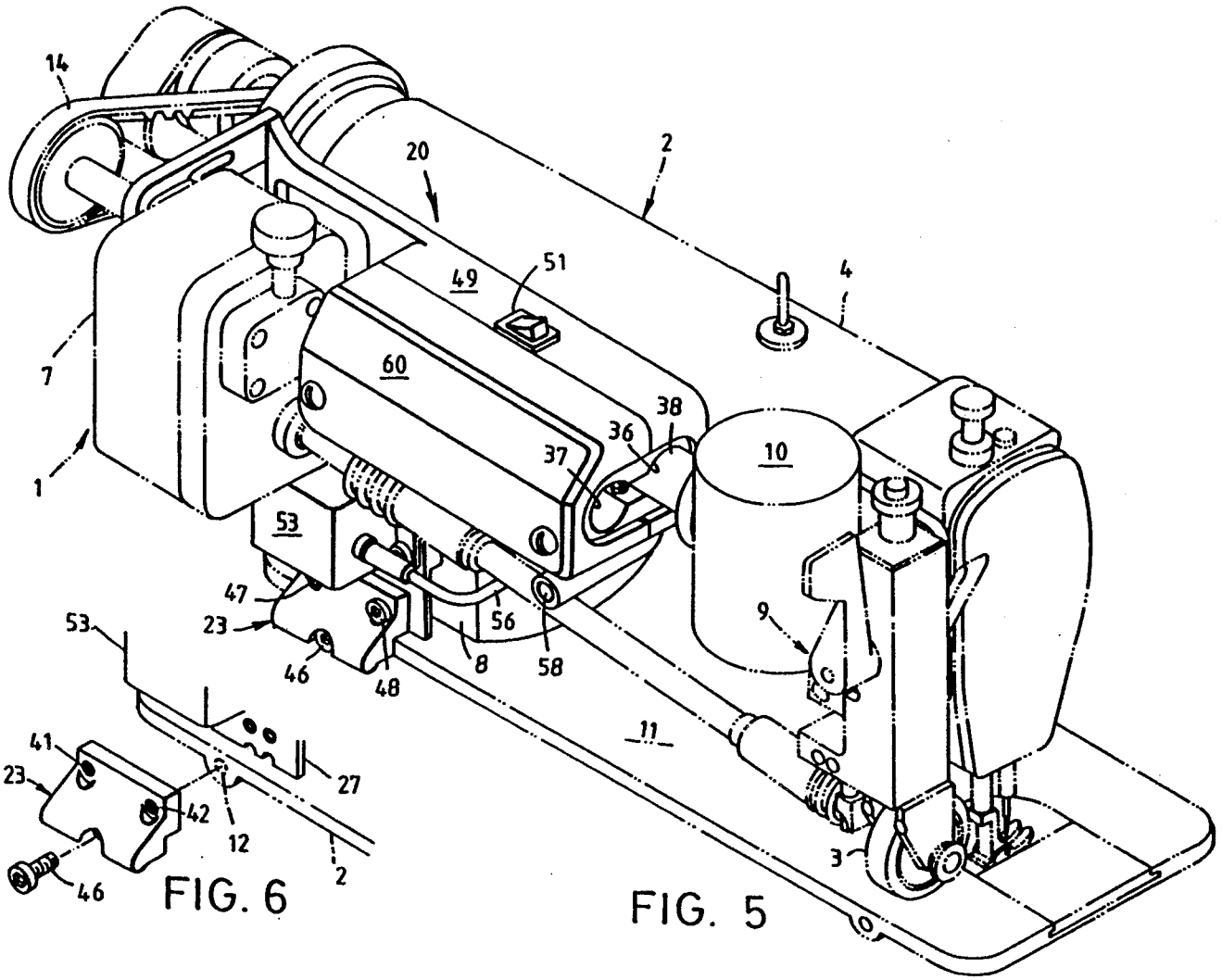
FIG. 5 is an isometric view, showing both the connecting device and the cloth pulling arrangement assembled with a sewing machine, in accordance with the present invention.
FIG. 6 is a local exploded isometric view showing the lower left corner of FIG. 5 before assembling in accordance with the present invention.
Figure 7:
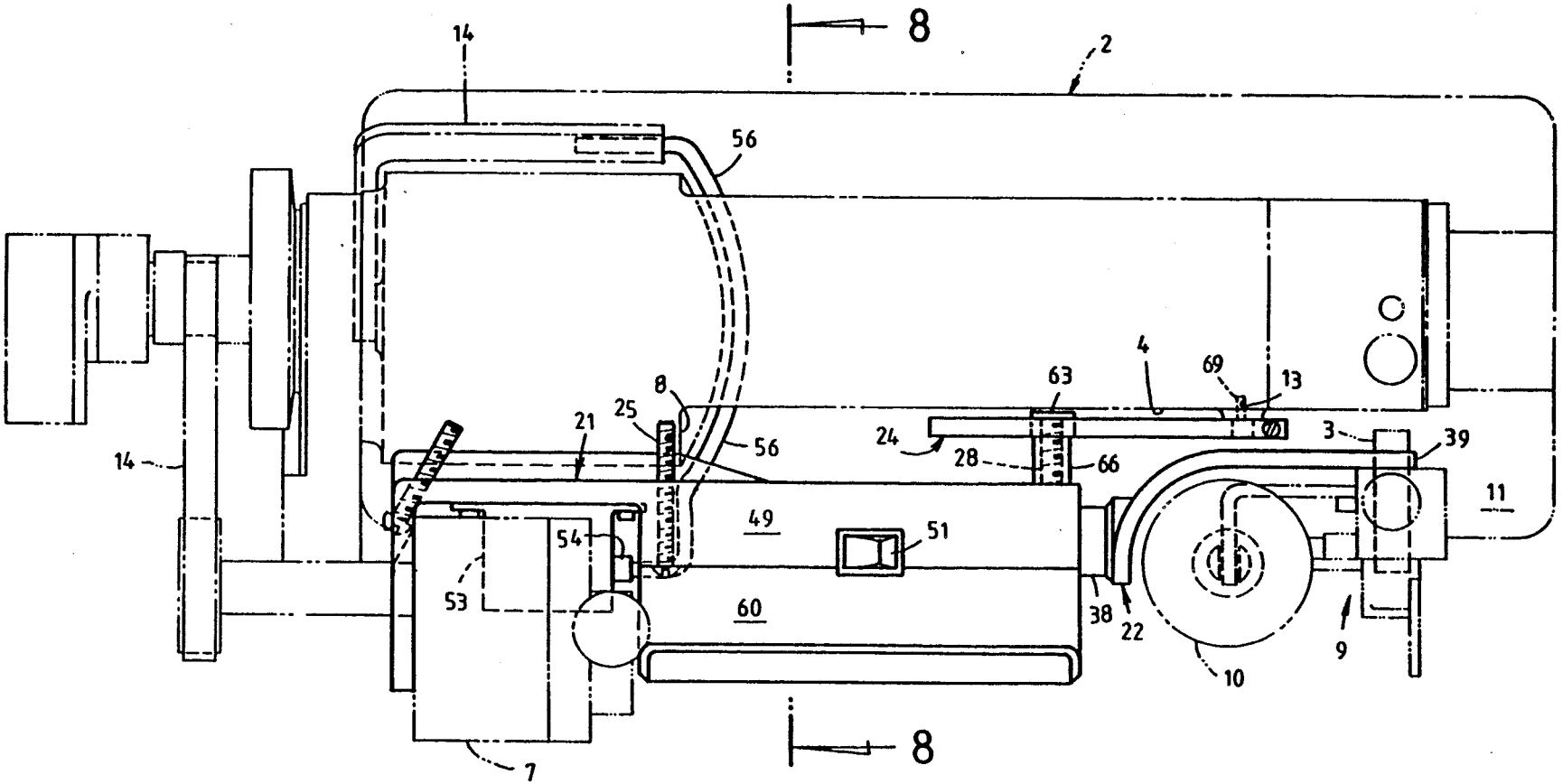
FIG. 7 is a top plan view, showing the connecting rod engaged with the back sewing control lever of a sewing machine, in accordance with the present invention.
Figure 8:
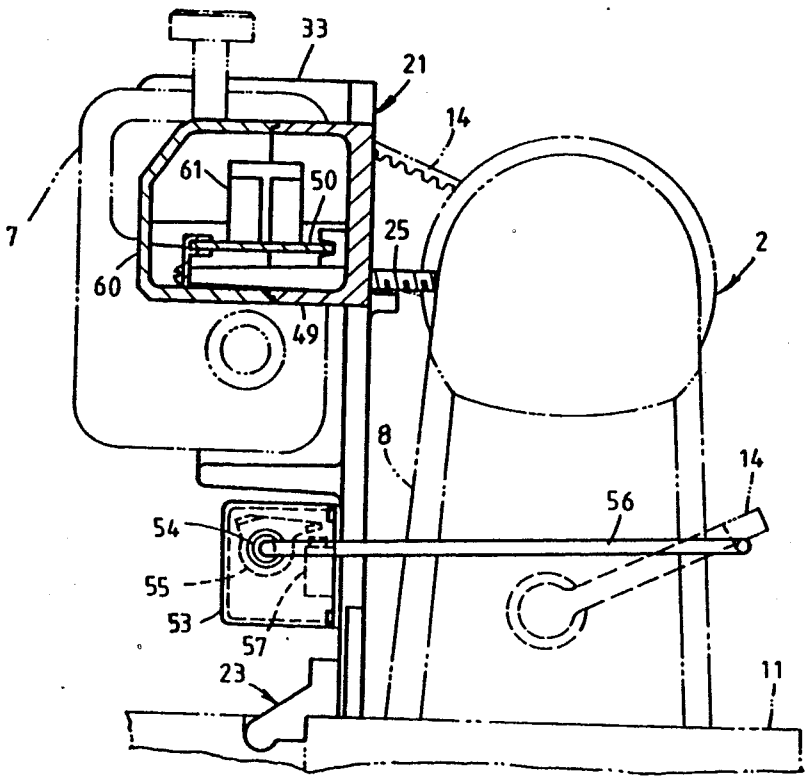
FIG. 8 is a cross sectional view taken along line I—I of FIG. 7, showing the switch, switch trigger and the connecting rod.

The second connecting member 22 has a pivot portion 38 and a fourth connecting portion 39. There are two connecting grooves 40 on the fourth connecting portion 39, and the pivot portion 38 is pivoted with one of the pivot holes 36 or 37 as required. The second connecting member 22 is used to fix the cloth pulling roller assembly 9 and the solenoid actuator 10 as shown in FIG. 5.

There are two fixing holes 41, 42 and a locking hole 43 on the first fixing member 23. Bolts 47, 48, 46 are respectively mounted in holes 41, 42, 43.

The second fixing member 24 has a connecting hole 44 and a connecting groove 45. A connecting block 63 is encased in the connecting groove 45 of the second fixing member 24. The connecting block 63 has an internal screw hole 64 and an adjustable sleeve 65 with an external thread 66 is screwed in a hole 67 of the first connecting member 21.

The first connecting member 21 has a box 49; a control circuit 61 laid on a control circuit board 50 to be used to control the solenoid actuator 10, the control circuit board 50 being installed in the connecting box 49; and a power switch 51 installed in a connecting opening 52 formed on an upper wall of the box 49.

As shown in FIGS. 3, 4, 5, 7 and 8, a switch box 53 is fixed on the back of the first connecting member 21; a rotary shaft 54 rotatably is mounted in the box 53; a switch trigger 55 is fixed on one end of the shaft 54; and a U-shaped connecting rod 56 goes around the post 8 of the sewing machine and is positioned below the back sewing control lever of the sewing machine. There is a limit switch 57 mounted adjacent the switch trigger 55 inside the switch box 53. On back sewing, the operator may press the back sewing control lever and push the connecting rod 56 downward and then the pivot shaft 54 and the switch trigger 55 would turn together. The switch trigger 55 actuates the limit switch 57 to cause the solenoid actuator 10 to act and lift up the cloth pulling roller 3 to facilitate back sewing.

During assembly, as shown in FIG. 4, a connecting hinge is dismantled between a work surface 11 of the sewing machine 2 and a wooden table (there is a connecting hinge on every sewing machine). A first fixing hole 12 already existing in the sewing machine 2 receives a screw tap to tap an internal thread along the fixing hole 12. Next, a fixing bolt 46 extends through the locking hole 43 of the first fixing member 23 and is threaded into the fixing hole 12 of the sewing machine 2 in order to fix the first fixing member 23 firmly on the rear of the sewing machine 2. Then two bolts 47, 48 extend through the fixing holes 29, 30 or 31, 32 as shown in FIG. 3 of the first connecting member 23 (as shown in FIG. 6) to fix the bottom of the first connecting member 21. The left side of the first connecting member 21 receives a fixing bolt 25 and is pressed against the back 8 of the post. The right and upper ends of the first connecting member 21 are fixed into a fixing hole 13 on the back of a hanging arm 4 with a bolt, the second fixing member 24, the connecting sleeve 65, and the connecting block 63. The second fixing hole 13 is standard and part of the layout of the sewing machine. The hole 13 is used originally to mount a lighting lamp. During assembly, the second fixing member 24 is mounted into the second fixing hole 13 with two bolts 69, 70 at first, and then the length of the connecting sleeve 65 to be extended out of the back of the first connecting member 21 is adjusted to make it push against the second fixing member 24. Finally, the bolt 28 extends into the hole 71 of the connecting sleeve 65 and is mounted in the tap hole 64 of the connecting block 63. The first connecting member 21 would then be fixed wholly on the back of the sewing machine 2.

The second connecting member 22 is inserted into the first pivot hole 36 of the first connecting member 21 by means of its cylindrical pivot portion 38. If the sewing machine is equipped with an automatic thread cutting solenoid actuator, the pivot portion 38 would be inserted into the second pivot hole 37 to prevent the solenoid actuator from being affected. The pivot portion is fixed with bolts 59, 62. The cloth pulling roller assembly 9 and solenoid actuator 10 are fixed on the rear of the second connecting member 22, and the position of the cloth pulling roller assembly 9 is adjusted to maintain the cloth pulling roller 3 pressed on the work surface 11 of the sewing machine 2.

The governor 7 is fixed on the side of the second connecting portion 33 via the fixing holes 34.

To complete the assembly, the upper left corner, upper right corner and lower right corner of the first connecting member 21 are fixed respectively to be extremely firm, in which the upper left corner is supported by both the inward pulling force of the belt 14 and the outward tensile force of the fixing bolt 25.

As shown in FIG. 3, there is a fixing hole 58 on the lower right part of the first connecting member 21, as the original fixing hole 13 has been used to install the second fixing member 24. The fixing hole 58 is now used to install a lighting fitting.

The box 49 on the first connecting member 21 is covered by a cover 60.

The power switch 51 mounted on the box 49 is used to control the power supply of the control circuit 61 and the solenoid actuator 10.

The main feature of the present invention is to utilize the first connecting member 21 and the second connecting member 22 to connect the cloth pulling arrangement 1 to sewing machines of various brands and types without drilling any holes in the sewing machine. The invention provides the following advantages:

a. The operation of assembly becomes simpler.

b. A single type connecting structure is applicable to various brands and types of sewing machines; it not only decreases the quantity of warehousing of the product greatly, but also causes the management and manufacture of the product to be simplified.

c. No drilling of holes in the sewing machine is required. The case of the sewing machine is not ruined. The installation may be dismantled easily once it is not required.

d. As both the installing and removing of this product are simple, the ready-made clothes factory itself is able to handle the matter. It is convenient for the ready-made factories and the cloth pulling arrangement manufacturer.

e. Since the connecting structure is the same for all sewing machines, no misunderstanding and annoyance would occur between the ready-made factory and the manufacturer of the cloth pulling arrangement.

I claim:

1. A connecting assembly for mounting a cloth pulling arrangement on a sewing machine, (A) said sewing machine being of the type including (i) a work surface for supporting cloth to be sewn;

(ii) a housing above the work surface and including a post having a back, and an arm extending from the post, said housing having existing holes;

(iii) a reciprocating sewing needle mounted on the arm for movement toward and away from the work surface;

(iv) a drive for moving the needle, and for advancing the cloth underneath the moving needle in a forward direction in a forward mode, and for retreating the cloth underneath the moving needle in a reverse sewing direction in a reverse mode; and (B) said cloth pulling arrangement being of the type including (i) a governor driven by the drive;

(ii) a cloth pulling assembly including a cloth pulling roller driven by the governor and engaging the cloth being sewn to pull the cloth taut to resist the formation of wrinkles in the cloth during the forward mode; and (iii) solenoid actuator means for lifting the cloth pulling roller out of engagement with the cloth during the reverse mode, said connecting assembly comprising:

(a) a first connecting member having first and second connecting portions, (b) a second connecting member mounted on the arm and connected to the first connecting member, (c) a first fixing member for fixedly mounting the first connecting portion of the first connecting member to the back of the housing using one of the existing holes, (d) a second fixing member for fixedly mounting the first connecting portion of the first connecting member to the back of the housing using another of the existing holes, (e) means for mounting the governor to the second comprising portion of the first connecting member, and (f) means for mounting the cloth pulling assembly and the solenoid actuator means to the second connecting member.

2. The connecting assembly according to claim 1, wherein the first and second connecting portions of the first connecting member extend perpendicularly of each other.

3. The connecting assembly according to claim 1, wherein the first connecting portion includes two pairs of fixing holes, and wherein the first fixing member includes a pair of mounting holes which is aligned with one of the pairs of fixing holes.

4. The connecting assembly according to claim 1, wherein the first connecting member has a pair of pivot holes, and wherein the second connecting member has a pivot portion received in a selected one of the pivot holes.

5. The connecting assembly according to claim 1, wherein the second fixing member includes an elongated slot, and further comprising means in said slot for mounting the first connecting member to the back of the machine.

6. The connecting assembly according to claim 1, wherein the first connecting member includes a box having a removable cover, and wherein the solenoid actuator means includes control means mounted in the box.

7. The connecting assembly according to claim 6, wherein the control means includes a movable trigger member, a limit switch mounted adjacent the trigger member and an elongated control lever having one end connected to the trigger member, and an opposite end in force-transmitting relationship with a reverse mode lever on the sewing machine.

* * * * *